US009776842B2

(12) United States Patent
Uyeno

(10) Patent No.: US 9,776,842 B2
(45) Date of Patent: Oct. 3, 2017

(54) SELF-ASSEMBLING INFLATABLE MODULES

(71) Applicant: Raytheon Company, Waltham, MA (US)

(72) Inventor: Gerald P. Uyeno, Tucson, AZ (US)

(73) Assignee: RAYTHEON COMPANY, Waltham, MA (US)

( * ) Notice: Subject to any disclaimer, the term of this patent is extended or adjusted under 35 U.S.C. 154(b) by 340 days.

(21) Appl. No.: 13/623,783

(22) Filed: Sep. 20, 2012

(65) Prior Publication Data

US 2014/0077141 A1 Mar. 20, 2014

(51) Int. Cl.

| | |
|---|---|
| ***B66F 3/35*** | (2006.01) |
| *A62C 3/02* | (2006.01) |
| *A63H 27/10* | (2006.01) |

(52) U.S. Cl.

CPC ..... *B66F 3/35* (2013.01); *A62C 3/025* (2013.01); *A63H 2027/1066* (2013.01)

(58) Field of Classification Search

CPC ... E04H 15/20; B66F 3/35; A63H 2027/1066; A63H 2027/1033

USPC ..... 169/46, 36, 30, 91, 48–50, 60–61, 64; 254/93 HP

See application file for complete search history.

(56) References Cited

U.S. PATENT DOCUMENTS

| | | | | |
|---|---|---|---|---|
| 2,655,369 | A * | 10/1953 | Musilli | 267/113 |
| 4,934,986 | A * | 6/1990 | Wallace | 446/222 |
| 5,501,284 | A * | 3/1996 | Clodfelter | A62C 99/0018 169/54 |
| 6,409,561 | B1 * | 6/2002 | Ibasfalean | B63C 9/0005 441/41 |
| 6,417,764 | B2 * | 7/2002 | Tonkin | 340/425.5 |
| 6,918,447 | B2 * | 7/2005 | Robinson, Jr. | E06B 9/0692 160/44 |
| 7,544,111 | B2 * | 6/2009 | Isberg | B63C 9/18 222/5 |
| 2004/0063380 | A1 * | 4/2004 | Chi | A63H 33/046 446/220 |
| 2005/0269805 | A1 * | 12/2005 | Kalliske et al. | 280/730.1 |
| 2006/0202452 | A1 * | 9/2006 | Breed et al. | 280/730.2 |
| 2008/0001130 | A1 * | 1/2008 | Dibdin | 254/93 HP |
| 2008/0306506 | A1 * | 12/2008 | Leatherman | 606/192 |

OTHER PUBLICATIONS

Non-Patent Literature: Jasmine Swarmrobot _ Open-source micro-robotic project.*

* cited by examiner

*Primary Examiner* — Arthur O Hall
*Assistant Examiner* — Tuongminh Pham

(57) ABSTRACT

A system includes a plurality of inflation balls configured to be launched and a connection mechanism. The plurality of inflation balls are configured to modularly inflate with respect to one another to create a combined modular volume. The connection mechanism is configured to allow the modular inflation of the plurality of inflation balls with respect to one another.

20 Claims, 5 Drawing Sheets

SELF-ASSEMBLING INFLATABLE MODULES

TECHNICAL FIELD

This disclosure is generally directed to assistance systems. More specifically, this disclosure is directed to self-assembling inflatable modules.

BACKGROUND

A variety of different structures are used to lift vehicles (e.g., hydraulic jacks) and resist crowds (e.g., irritant gases). However, such structures can be bulky and unnecessarily harm a crowd. Additionally, in certain scenarios, no suitable structures exist for handling objects that have irregular shapes.

SUMMARY

This disclosure provides a system with self-assembling inflatable modules.

According to an embodiment, a system includes a plurality of inflation balls configured to be launched and a connection mechanism. The plurality of inflation balls are configured to modularly inflate with respect to one another to create a combined modular volume. The connection mechanism is configured to allow the modular inflation of the plurality of inflation balls with respect to one another.

Certain embodiments may provide various technical advantages depending on the implementation. For example, a technical advantage of some embodiments may include the capability to stop people from moving or force people out of a building. A technical advantage of other embodiments may include the capability to lift vehicles or other objects having an irregular surface. Yet another technical advantage may include the capability for lifting submerged objects. Yet another technical advantage may include the capability to seal off areas.

Although specific advantages have been enumerated above, various embodiments may include some, none, or all of the enumerated advantages. Additionally, other technical advantages may become readily apparent to one of ordinary skill in the art after review of the following figures and description.

BRIEF DESCRIPTION OF THE DRAWINGS

For a more complete understanding of this disclosure and its features, reference is now made to the following description, taken in conjunction with the accompanying drawings, in which.

DETAILED DESCRIPTION

FIGS. 1 through 11, described below, and the various embodiments used to describe the principles of the present invention in this patent document are by way of illustration only and should not be construed in any way to limit the scope of the invention. Those skilled in the art will understand that the principles of the present invention may be implemented in any type of suitably arranged device or system.

Figure 1A:
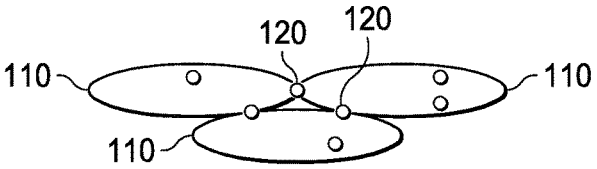
FIGS. 1A and 1B illustrate general aspects of embodiments of the disclosure.
Figure 1B:
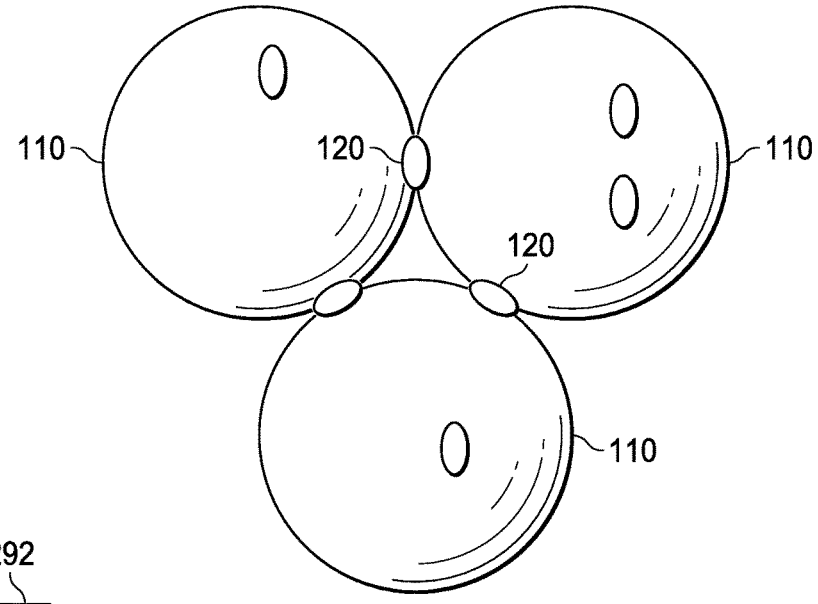

FIGS. 1A and 1B illustrate general aspects of embodiments of the disclosure. In FIGS. 1A and 1B, a plurality of balls 110 are shown being inflated and connected to one another with a connection mechanism 120. A variety of applications can avail from the volume created by the combined structure of the plurality of balls 110. As will be described in further details below, the balls 110 may be remotely or autonomously activated to inflate and occupy a volume. Non-limiting examples of such applications will be provided below with reference to other figures.

FIG. 1A shows balls 110 that are deflated. FIG. 1B shows the balls 110 inflated. Positioned between the balls 110 is a connection mechanism 120 that helps the balls 110 assemble or inflate with respect to one another. More specifically, in particular configurations, the connection mechanism 120 keeps the balls 110 connected to one another. In particular configurations, the balls are connected in the uninflated state. In other configurations, the balls may be disconnected in the uninflated states and then connect during inflation.

As will be described below, a variety of connection mechanisms 120 may be utilized. In FIGS. 1A and 1B, the connection mechanism 120 may represent a glue or magnets positioned on the balls 110. Other connection mechanisms may also be utilized.

Only three balls 110 are shown in FIGS. 1A and 1B; however, more than three balls 110 may be utilized, depending on the application. Additionally, although the shape will be described as a "ball," a variety of other inflation modules may be utilized according to embodiments of the disclosure. Any suitable material may be utilized for these structures. In particular configurations, the material may be elastic—stretching as the inflation module inflates.

Figure 2A:
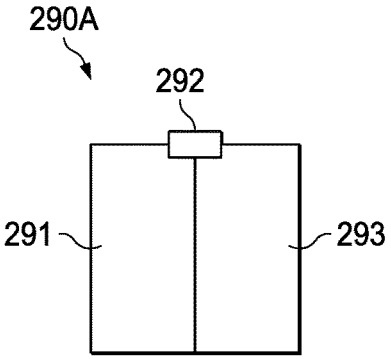
FIGS. 2A, 2B, and 2C show a variety of configurations for on-demand inflation, according to embodiments of the disclosure.
Figure 2B:
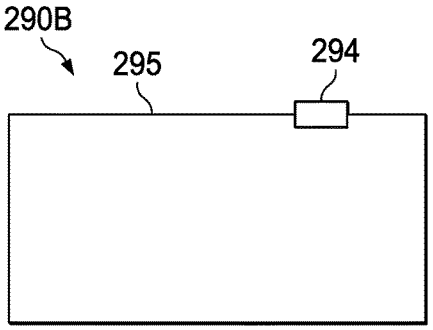
Figure 2C:
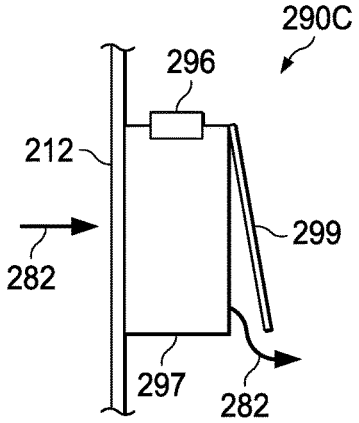

FIGS. 2A, 2B, and 2C show a variety of configurations for on-demand inflation, according to embodiments of the disclosure.

FIG. 2A shows a first inflation mechanism 290A, according to an embodiment of the disclosure. The first inflation mechanism 290A includes a first container 291, a second container 293, and a first inflation activator 292. The first container 291 may include a first substance and the second container 293 may include a second substance. Each substance may be either a chemical or a reaction mechanism (e.g., something that generates electricity or heat). Additionally, although only two containers are shown, more than two containers may be utilized.

Upon an interaction between the substances, a gas or vapor forms. For purposes of brevity, such an interaction will not be described as a variety of such interactions will become apparent to one of ordinary skill in the art after review of this disclosure. A non-limiting example is the activation of Sodium Azide, which yields Nitrogen gas, among other products. When the first inflation mechanism 290A is placed inside a ball, the gas or vapors may cause the ball to inflate.

The first inflation activator 292 may include a variety of mechanisms that allow the first and second substances to interact. Any of a variety of actuation structures may be utilized, including valves and switches. As non-limiting examples, the first inflation activator 292 may be time-based, wirelessly activated, or sensor activated (e.g., by temperature or acceleration). As an example of a time-based activation, a trigger similar to a grenade trigger may be set, specifying that the substances will be allowed to interact at a set time (which may be several seconds or several minutes) after the trigger is set.

As an example of wireless activation, any of a variety of wireless features may be utilized to initiate activation. For example, the first inflation activator 292 may include an antenna that, upon receiving a signal, causes the first and second substances to interact.

As an example of a sensor activation by acceleration, an accelerometer may be utilized to determine relative movement of the first inflation activator 292. For example, the accelerometer could detect a tossing of the first inflation activator 292 and then a lack of movement (e.g., when it hits the ground) and be programmed to be activated after such occurrences. Similarly, a sensor may detect a change in temperature or exceeding of a particular temperature and cause activation.

In addition to the above, the first inflation activator 292 may also include a proximity sensor that detects the relative location of other balls nearby. In such a scenario, the first inflation activator 292 may only activate when a ball is less than a certain distance nearby.

Although specific examples have been disclosed for the first inflation activator 292, others may also be utilized in embodiments of the disclosure.

FIG. 2B shows a second inflation mechanism 290B, according to an embodiment of the disclosure. The second inflation mechanism 290B includes a container 295 and a second inflation activator 294. The second inflation mechanism 290B may include a compressed fluid that upon being released will cause the ball to inflate. When the second inflation mechanism 290B is placed inside a ball, the release of the compressed fluid causes the ball to inflate.

The second inflation activator 294 may include a variety of mechanisms which allow the release of the compressed fluid to inflate the ball.

Similar to that described above with reference to the first inflation activator 292, any of a variety of valves or actuation structures may be utilized to allow a release of compressed fluid. Additionally, any of the activation structures described above with reference to the first inflation activator 292 may also be utilized with the second inflation activator 294.

FIG. 2C shows a third inflation mechanism 290C, according to an embodiment of the disclosure. The third inflation mechanism 290C includes a pump 297 and a third inflation activator 296. The pump 297 may be positioned either adjacent or on a wall 212 of a ball and be in fluid communication with ambient air. In such a configuration, a flow of air indicated by arrows 282 may pass from an exterior of the ball through the pump 297 to the interior of the ball. To keep air trapped within an interior of the ball, any suitable structure may be utilized. In the example of FIG. 2C, a spring reinforced door 299 may force close an exit of the pump 297 and only open when air pressure from the pump 297 pushes open the door 299.

The third inflation activator 296 may include any suitable mechanism for activating the pump 297. Any of the activation structures described above with reference to the first inflation activator 292 may also be utilized with the third inflation activator 296.

Although example inflation techniques have been provided above, one of ordinary skill in the art will recognize other techniques after reviewing this disclosure.

Additionally, although the inflation has been shown with remote independent inflation above in particular configurations, the balls may also be inflated with a structure that supplies compressed gas (e.g., air, fire retardant, tear gas) to each of the plurality of balls. For example, a fluid connection line may be connected to each of the plurality of balls and be supplied by a structure (e.g., pump or tank) that supplies compressed air.

FIGS. 3A, 3B, 4A, 4B, 5A, and 5B illustrate various connection mechanisms and methods of dispersing inflation modules, according to embodiments of the disclosure. In certain configuration, the inflation modules may be manually placed or tossed in positions. In other configurations, other devices may be utilized to launch the inflation modules. Additionally, the placement of the connection mechanisms may vary. In certain configurations, the connection mechanisms may connect two inflation modules prior to inflation. In other configurations, the connection mechanisms may couple two inflation modules during or after inflation.

Figure 3A:
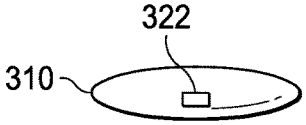
FIGS. 3A, 3B, 4A, 4B, 5A, and 5B illustrate various connection mechanisms and methods of dispersing inflation modules, according to embodiments of the disclosure.
Figure 3B:
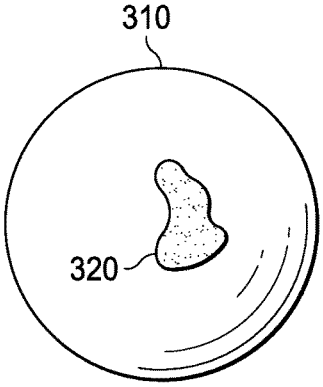

FIGS. 3A and 3B show a placement of a glue 320 on a ball 310 as it inflates. In FIG. 3A, an uninflated ball 310 includes a packet 322 that contains glue. At a point in inflation, the packet 322 bursts and the glue 320 disperses over a cover of the ball 310. Yet another configuration includes having a glue cover the ball 310 that remains in an airtight container. Upon exposure of the ball and glue to air, the sticky qualities of the glue may begin to operate. In yet further configurations, the stretching, itself, may activate a glue.

Figure 4A:
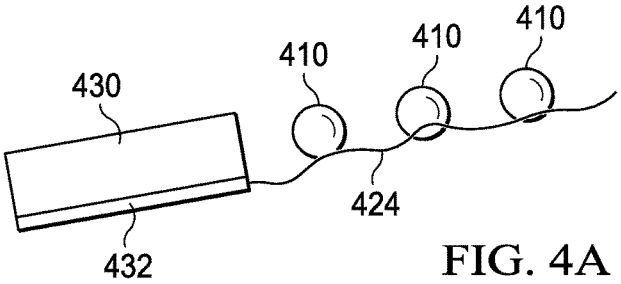
Figure 4B:
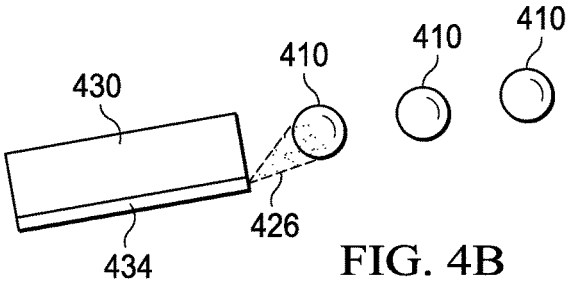

FIGS. 4A and 4B show a launching mechanism 430 for inflation modules or balls 410, according to an embodiment of the disclosure. The launching mechanism 430 may utilize any suitable launching technique. As a non-limiting example, in certain embodiments, the launching mechanism 430 may utilize principles similar to launch of paint balls in paint ball guns. The launching mechanism 430 may allow the placement of a plurality of inflation modules at a distance from the launching mechanism 430.

In FIG. 4A, the launching mechanism 430 has a string dispenser 432 attached thereto. The string dispenser 432 launches a sticky and flexible string 424 that servers as the connection mechanism for launched balls 410. A non-limiting example of such sticky string is developed by Engineering Science Analysis under the market name SQUID.

In FIG. 4B, the launcher 430 has a glue sprayer 434 attached thereto. The glue sprayer 434 sprays a glue 426 on the plurality of balls 410. Upon landing, some of the plurality of balls 410 may begin to stick to one another upon inflating.

In particular configurations, the flexible string 424 or the glue 426 may not only allow the balls 410 to stick together, but may also allow the balls 410 to stick to other structures.

Although the launching mechanism 430 has been shown with dispensers in the above configurations, in other configurations, the launching mechanism 430 may not have dispensers. Rather, the connection mechanisms may already be placed on the balls.

Figure 5A:
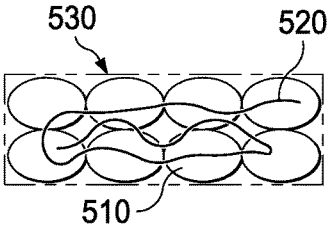
Figure 5B:
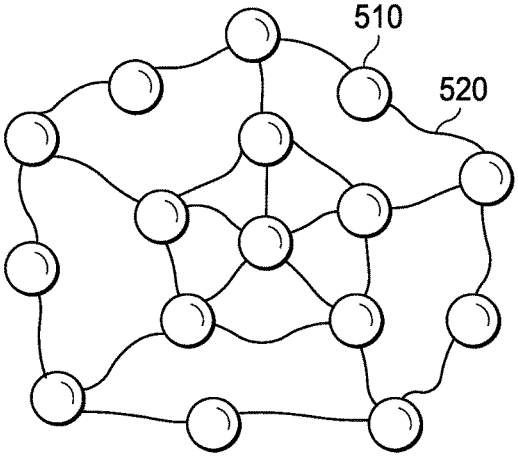

FIGS. 5A and 5B show the launching of balls 510 in a case 530, according to an embodiment of the disclosure.

FIG. 5A shows the balls 510 packed in the case 530 whereas FIG. 5B shows the balls 510 launched from the case 530 and connected by a flexible and sticky net 520. Any suitable technique may be utilized to launch the balls 510 from the case 530. In operation, the net 520 may help keep the balls 510 in position next to one another during and after inflation.

Figure 6A:
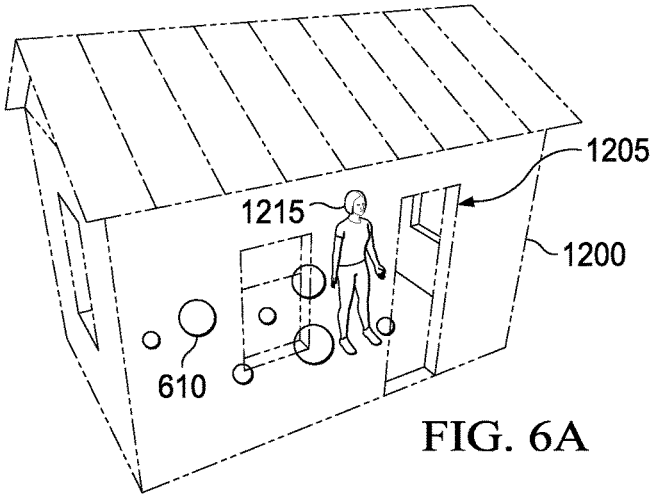
FIGS. 6A, 6B, and 6C illustrate an example use of the balls, according to an embodiment of the disclosure.
Figure 6B:
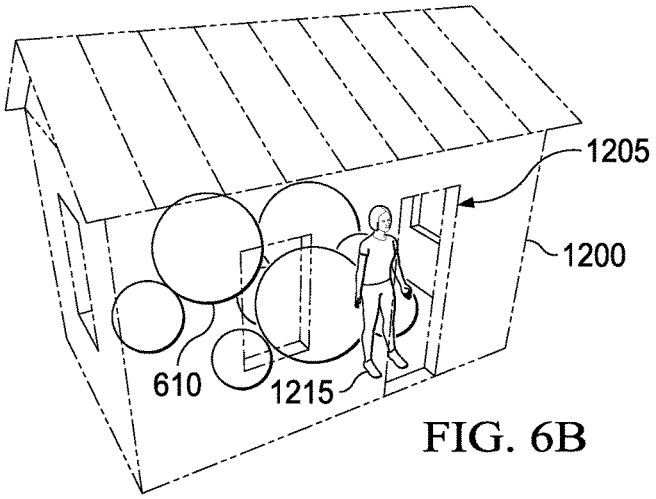
Figure 6C:
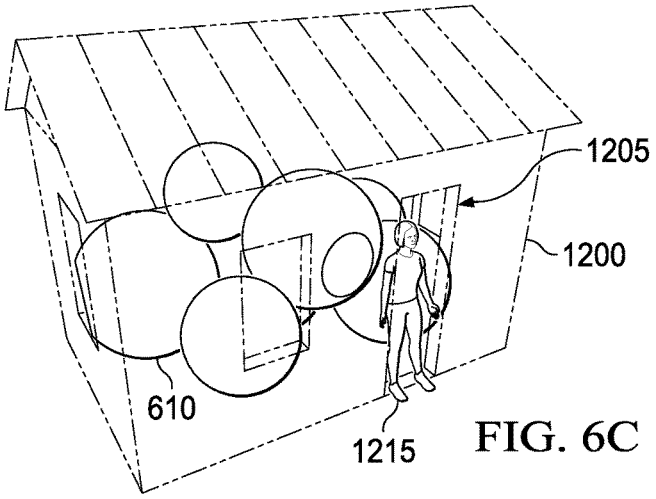

FIGS. 6A, 6B, and 6C illustrate an example use of the balls 610, according to an embodiment of the disclosure. In the illustration of FIGS. 6A, 6B, and 6C, a person 1215 may need to be forced to a leave a building 1200. The balls 610 provide a non-lethal manner of forcing the person 1215 from the building 1200.

FIG. 6A shows a ghosted view of the building 1200, which contains the person 1215. A plurality of balls 610 have been inserted into the building 1200, for example, through the windows or the doors. The balls 610 have begun to inflate with some balls 610 beginning to inflate earlier than others, for example, because they may have been sent into the building 1200 earlier than others. In addition the balls 610 may be filled with an irritant such as tear gas such that should an occupant of the building try to rupture the balls, they would release the irritant.

FIG. 6B shows the balls 610 starting to self-assemble and force the person towards a door 1205 of the building 1200.

FIG. 6C shows the balls reaching such an inflated stage that the person 1215 has no other choice, but to leave the building 1200.

Figure 7A:
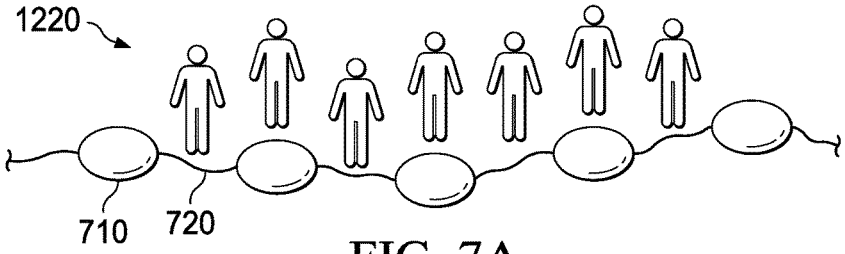
FIGS. 7A and 7B illustrate another example use of balls, according to an embodiment of the disclosure.
Figure 7B:
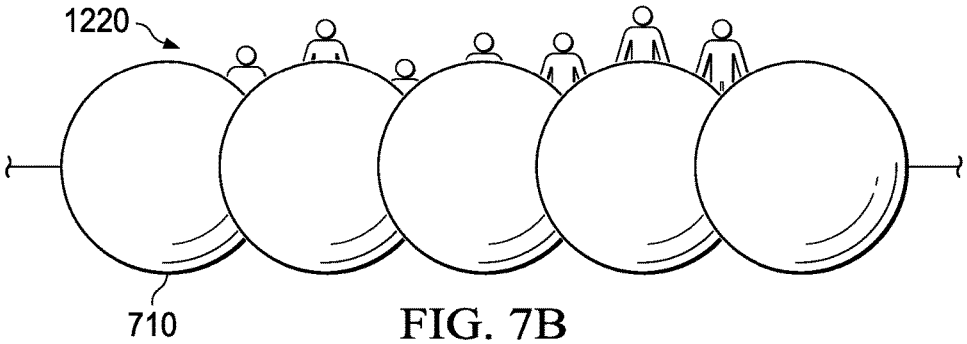

FIGS. 7A and 7B illustrate another example use of balls 710, according to an embodiment of the disclosure. In FIG. 7A, a crowd 1220 exists. A plurality of balls 710 with string 720 have been dispersed in front of the crowd 1220 in order to create a barrier. The string 720 may be a flexible sticky string which aids in the self-assembly of the barrier. The plurality of balls 710 may have been launched or placed in front of the crowd in any suitable manner, for example, including being launched with a launcher 430 of FIG. 4A or 4B or being projected from a case 530.

Additionally, in certain configurations, the string 720 may be a connection line for a structure that supplies compressed gas to each of the plurality of balls 710.

FIG. 7B shows the balls 710 inflated—effectively creating a barrier. In particular configurations, the balls 710—in addition to containing some gas or vapor that causes them to inflate—may contain an irritant to dissuade the crowd 1220 from puncturing the balls 710.

Figure 8:
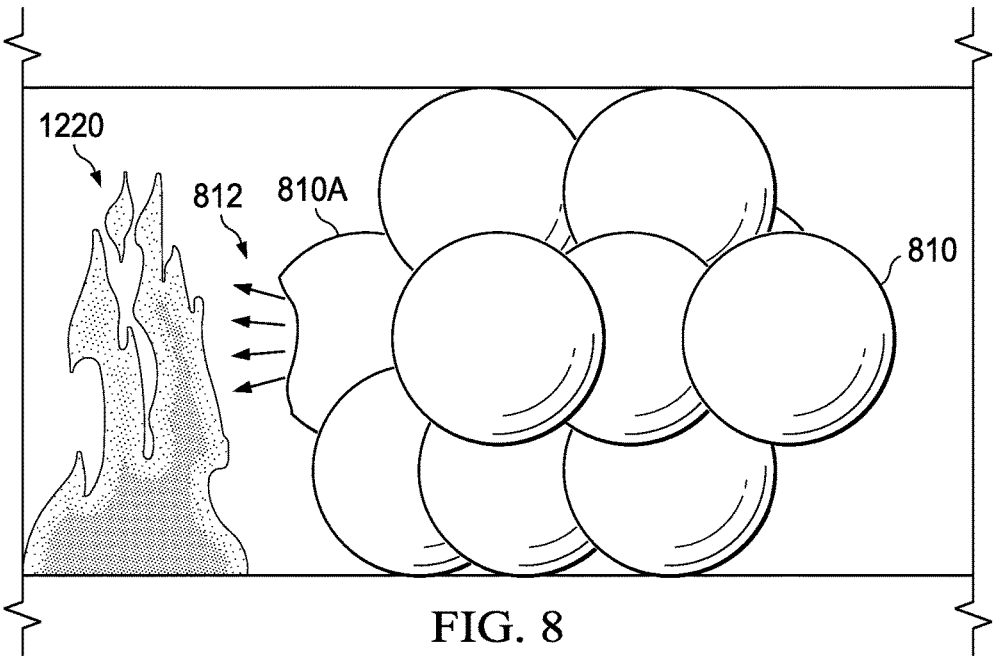
FIG. 8 illustrates another example use of the balls, according to an embodiment of the disclosure.

FIG. 8 illustrates another example use of the balls 810, according to an embodiment of the disclosure. In FIG. 8, a plurality of balls 810 have been assembled in a passage adjacent a fire 1220. The plurality of balls 810 may have a fire retardant placed therein, which may be injected into the ball upon inflation or generally be present while not inflated. A non-limiting example of a fire retardant is boron.

The ball 810A closest to the fire 1225 may melt and burst, releasing its fire retardant as indicated by the arrows 812. A configuration such as this may slow the spread of fire, for example, to an area 1227 on the opposite side of the passage containing the fire 1225.

The balls 810 may also serve to block the passage of air to the fire thereby starving the fire of oxygen and helping to suppress the fire. Additionally they may serve as a barrier preventing building occupants from inadvertently fleeing into a dangerous area.

Figure 9:
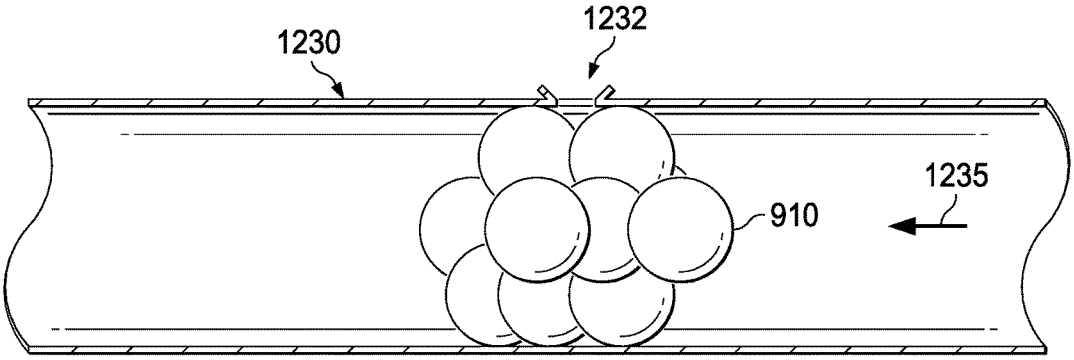
FIG. 9 illustrates another example use of the balls, according to an embodiment of the disclosure.

FIG. 9 illustrates another example use of the balls 910, according to an embodiment of the disclosure. In FIG. 9, a pipe 1230 may have burst as indicated by an opening 1232 in a side of the pipe 1230. The plurality of balls 910 in the deflated state may be small enough to be positioned in the opening 1232. Upon the plurality of balls 910 inflating, a flow of fluid (indicated by arrow 1235) may be prevented from exiting the pipe 1230.

Figure 10:
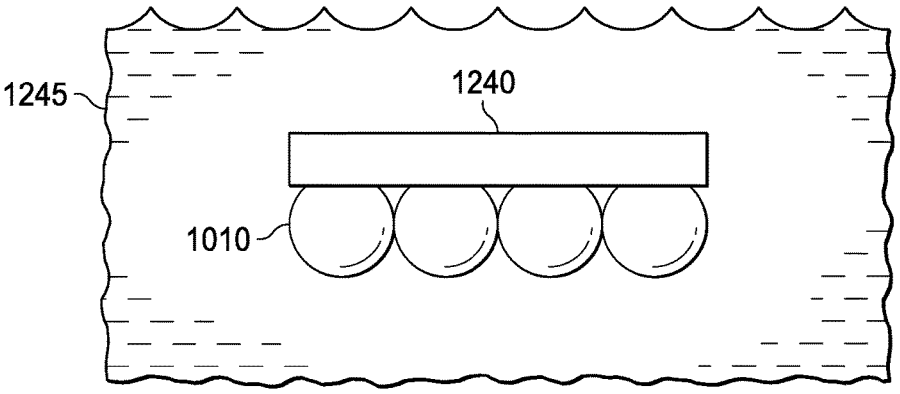
FIG. 10 illustrates another example use of the balls, according to an embodiment of the disclosure.

FIG. 10 illustrate another example use of the balls 1010, according to an embodiment of the disclosure. In FIG. 10, a plurality of balls 1010 are positioned underneath a structure 1240 that is under a body of water 1245. The balls 1010 may be positioned underneath the structure 1140. Then, upon inflation and using Archimedes principle, the balls may lift the structure 1140 upward in the water. In particular configurations, additional balls 1010 may be added until the desired lift force is provide.

Figure 11:
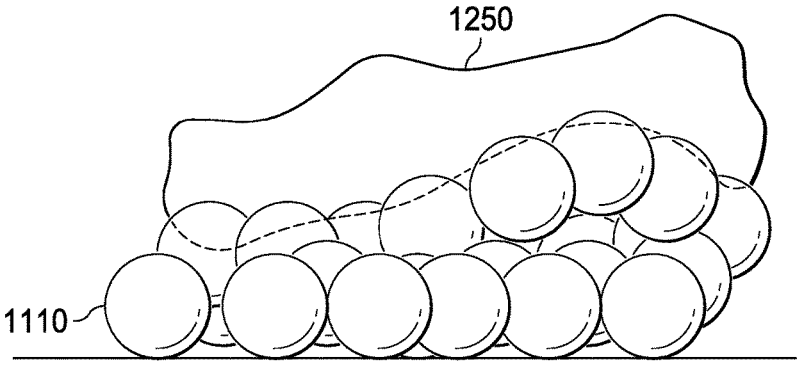
FIG. 11 illustrates yet another example use of the balls, according to an embodiment of the disclosure.

FIG. 11 illustrates yet another example use of the balls 1110, according to an embodiment of the disclosure. In FIG. 11, the balls are being used to lift an object 1250, which may have an irregular shape as indicated by the dashed lines on the bottom of the object. Upon inflating, the balls 1110 fill the gaps of the irregularly shaped object and allow it to lift. As a non-limiting example, several of the inflation modules may be placed under a stuck car on a dirt road.

In configurations such as FIG. 11, the inflation modules may provide lift capability typically provided by larger mechanical devices (e.g., jacks, hoists, winches). In certain configurations, the inflation may be provided to the plurality of balls with separate structure that supply compressed gas (e.g., air) to the inflation modules.

It may be advantageous to set forth definitions of certain words and phrases used throughout this patent document. The terms "include" and "comprise," as well as derivatives thereof, mean inclusion without limitation. The term "or" is inclusive, meaning and/or. The phrase "associated with," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, have a relationship to or with, or the like.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. A system comprising:

a plurality of inflation balls configured to be launched and released, the inflation balls configured, after launch and release, to inflate to create a combined modular volume; and a connector attached to one or more of the inflation balls, the connector configured to allow modular inflation of the inflation balls and to connect at least two of the inflation balls together after launch and release of the inflation balls;

wherein each of the inflation balls contains an inflation mechanism that (i) is configured to inflate the inflation ball in which the inflation mechanism is contained and (ii) includes an inflation activator configured to detect proximity of other inflation balls using a proximity sensor and activate inflation by the inflation mechanism as a function of a threshold distance with respect to at least one of the other inflation balls.

2. The system of claim 1, wherein the inflation mechanism for each of the inflation balls is configured to be wirelessly activated or activated based on a passage of time.

3. The system of claim 1, further comprising:

a launcher configured to launch and release the inflation balls prior to inflation of the inflation balls.

4. A system comprising:

a plurality of inflation modules configured to be launched and released and to modularly inflate, after launch and release, to create a combined modular volume; and a connector attached to one or more of the inflation modules, the connector configured to allow modular inflation of the inflation modules and to connect at least two of the inflation modules together after launch and release of the inflation modules;

wherein each of the inflation modules contains an inflation mechanism that (i) is configured to inflate the inflation module in which the inflation mechanism is contained and (ii) includes an inflation activator configured to detect proximity of other inflation modules using a proximity sensor and activate inflation by the inflation mechanism as a function of a threshold distance with respect to at least one of the other inflation modules.

5. The system of claim 4, wherein the inflation mechanism for each of the inflation modules is configured to be wirelessly activated.

6. The system of claim 4, wherein the inflation mechanism for each of the inflation modules is configured to be activated based on a passage of time.

7. A system comprising:

a plurality of inflation modules configured to modularly inflate to create a combined modular volume; and a connector configured to allow modular inflation of the inflation modules;

wherein each of the inflation modules has an inflation mechanism that (i) is configured to inflate the inflation module in which the inflation mechanism is contained and (ii) contains an inflation activator configured to detect proximity of other inflation mechanisms using a proximity sensor and activate inflation by the inflation mechanism as a function of a threshold distance with respect to at least one of the other inflation mechanisms.

8. The system of claim 4, wherein at least some of the inflation modules are balls.

9. The system of claim 4, further comprising:

a launcher configured to launch and release the inflation modules prior to inflation of the inflation modules.

10. The system of claim 9, further comprising:

a dispenser configured to launch the connector with the inflation modules.

11. The system of claim 4, wherein the connector is at least one of glue or magnets.

12. The system of claim 4, wherein at least some of the inflation modules contain a material that is an irritant or a fire retardant.

13. A method comprising:

launching and releasing a plurality of inflation modules to place the inflation modules in proximity to one another, the inflation modules configured, after launch and release, to inflate to create a combined modular volume;

inflating the inflation modules after launch and release; and connecting at least two of the inflation modules together after launch and release of the inflation modules using a connector attached to one or more of the inflation modules, the connector configured to allow modular inflation of the inflation modules;

wherein each of the inflation modules contains an inflation mechanism that (i) is configured to inflate the inflation module in which the inflation mechanism is contained and (ii) includes an inflation activator configured to detect proximity of other inflation modules using a proximity sensor and activate inflation by the inflation mechanism as a function of a threshold distance with respect to at least one of the other inflation modules.

14. The method of claim 13, wherein at least some of the inflation modules are balls.

15. The system of claim 7, wherein the inflation mechanism for each of the inflation modules is configured to be wirelessly activated or activated based on a passage of time.

16. The system of claim 7, further comprising:

a launcher configured to launch and release the inflation modules prior to inflation of the inflation modules.

17. The system of claim 1, wherein the inflation mechanism comprises multiple containers that include multiple substances that interact to cause inflation of the inflation balls.

18. The system of claim 17, wherein the substances interact to form gas or vapor that causes inflation of the inflation balls.

19. The system of claim 4, wherein the inflation mechanism comprises multiple containers that include multiple substances that interact to cause inflation of the inflation modules.

20. The system of claim 7, wherein the inflation mechanism comprises multiple containers that include multiple substances that interact to cause inflation of the inflation modules.

* * * * *